US012642421B2

(12) United States Patent
Ko

(10) Patent No.: US 12,642,421 B2
(45) Date of Patent: Jun. 2, 2026

(54) CUTLERY RACK AND DISHWASHER INCLUDING THE SAME

(71) Applicant: LG ELECTRONICS INC., Seoul (KR)

(72) Inventor: Myungwon Ko, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 161 days.

(21) Appl. No.: 18/545,476

(22) Filed: Dec. 19, 2023

(65) Prior Publication Data

US 2024/0197145 A1 Jun. 20, 2024

(30) Foreign Application Priority Data

Dec. 20, 2022 (KR) ..... 10-2022-0179214

(51) Int. Cl.
*A47L 15/22* (2006.01)
*A47L 15/50* (2006.01)

(52) U.S. Cl.
CPC ..... *A47L 15/502* (2013.01); *A47L 15/22* (2013.01)

(58) Field of Classification Search
None
See application file for complete search history.

(56) References Cited

U.S. PATENT DOCUMENTS

2021/0000325 A1 1/2021 Ko

FOREIGN PATENT DOCUMENTS

CN 106235986 A 12/2016
CN 110464283 A 11/2019

*Primary Examiner* — Levon J Shahinian
(74) *Attorney, Agent, or Firm* — Birch, Stewart, Kolasch & Birch, LLP

(57) ABSTRACT

Disclosed is a dishwasher. The dishwasher of the present disclosure includes: a tub which provides a washing chamber; a spray unit which is disposed in the washing chamber, and sprays washing water; and a cutlery rack which is disposed in the washing chamber, and comprises a plurality of bars, wherein the plurality of bars of the cutlery rack includes: a plurality of first bars arranged parallel to each other; and a plurality of second bars which extend along a direction in which the plurality of first bars are arranged and connect the plurality of first bars, and are arranged along a longitudinal direction of the first bar.

19 Claims, 17 Drawing Sheets

【Fig. 1】
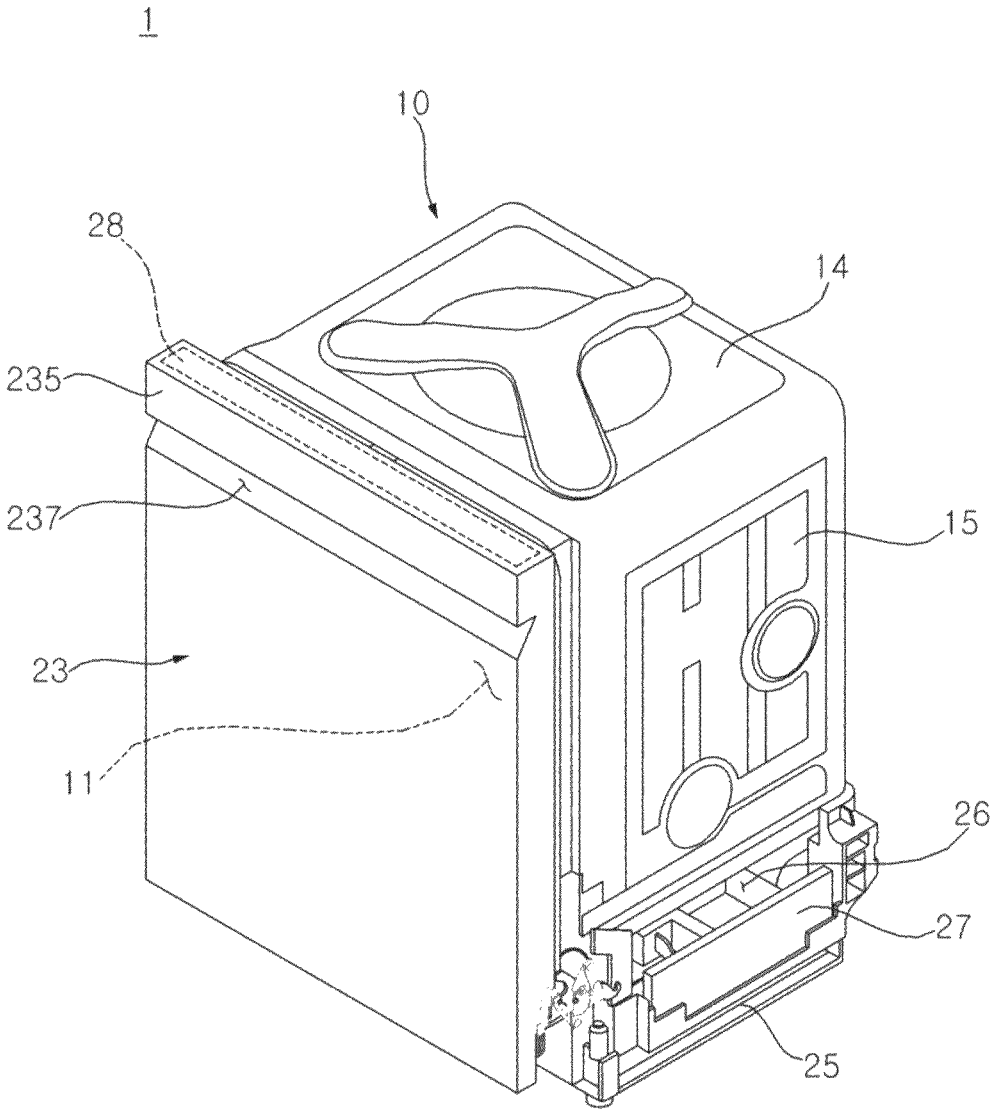

【Fig. 2】
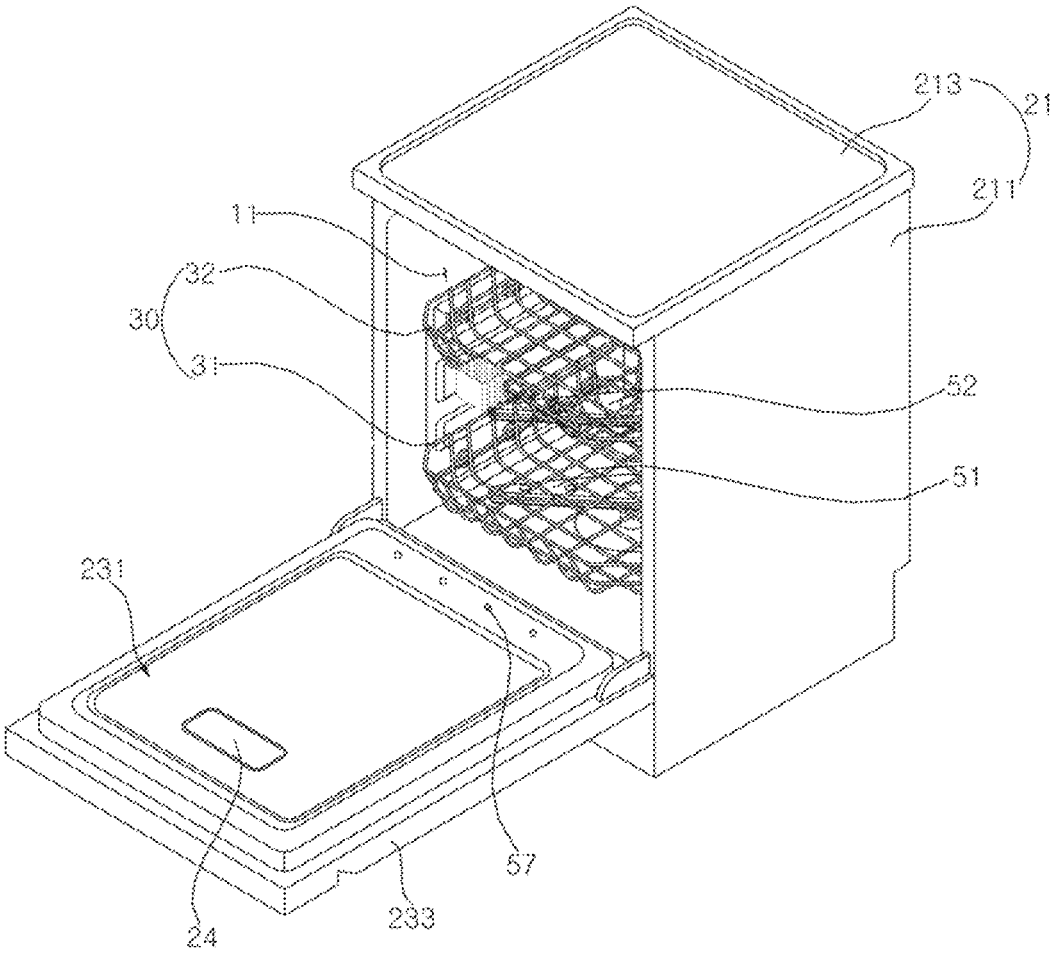

【Fig. 3】
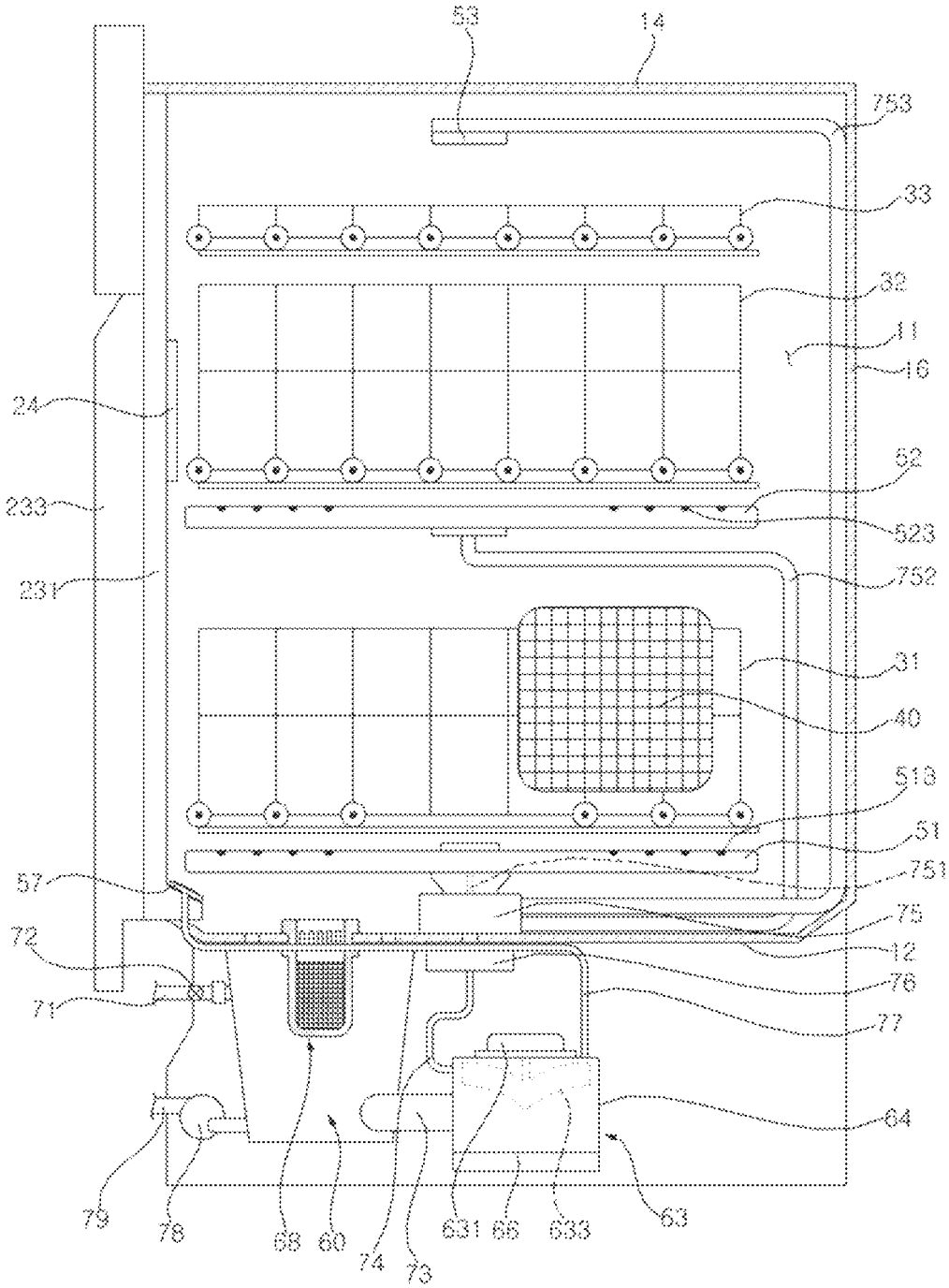

【Fig. 4】
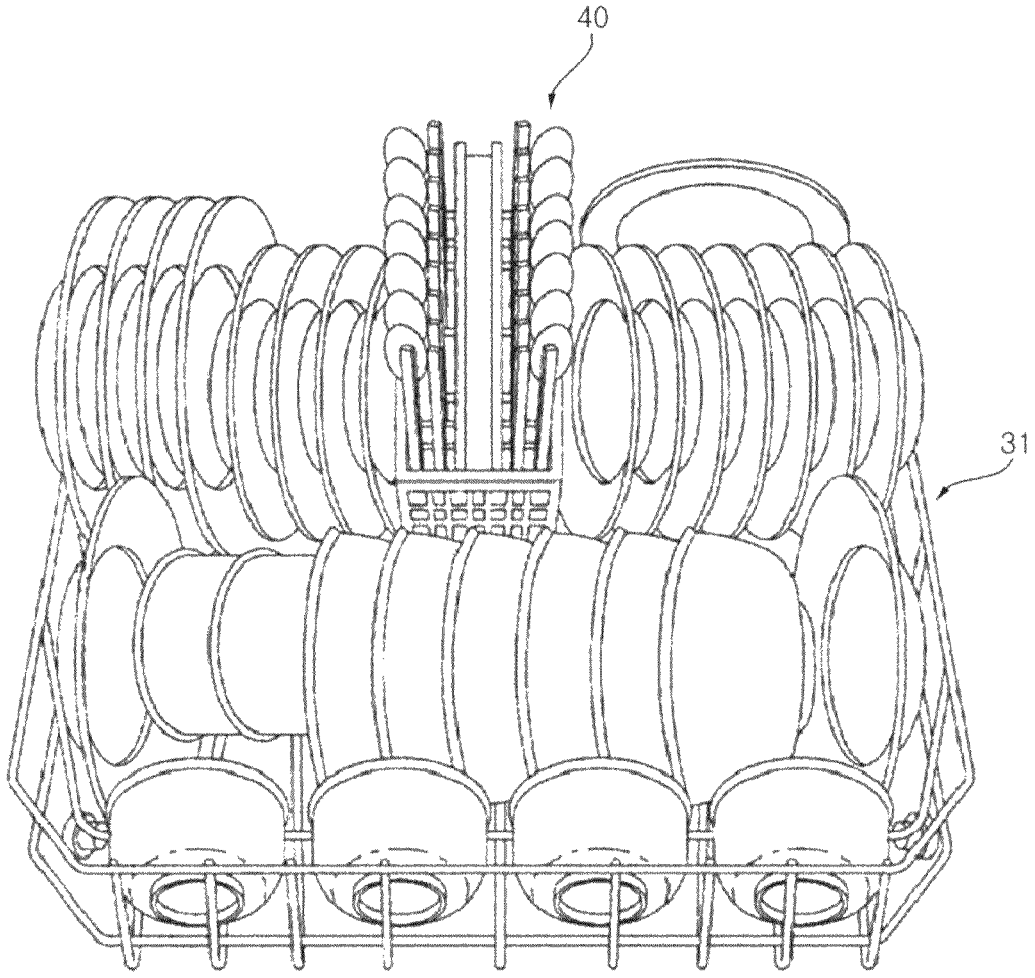

【Fig. 5】
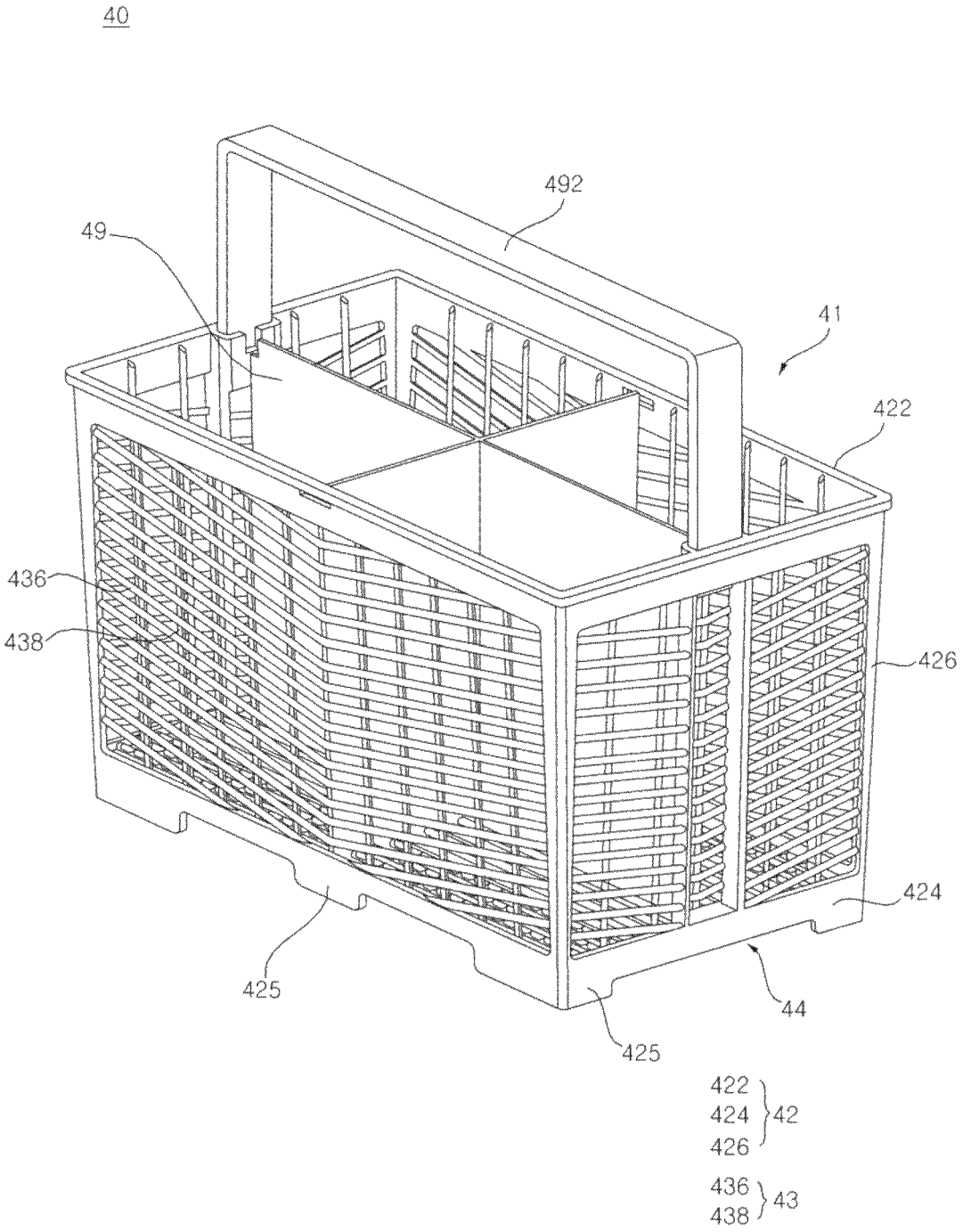

【Fig. 6】
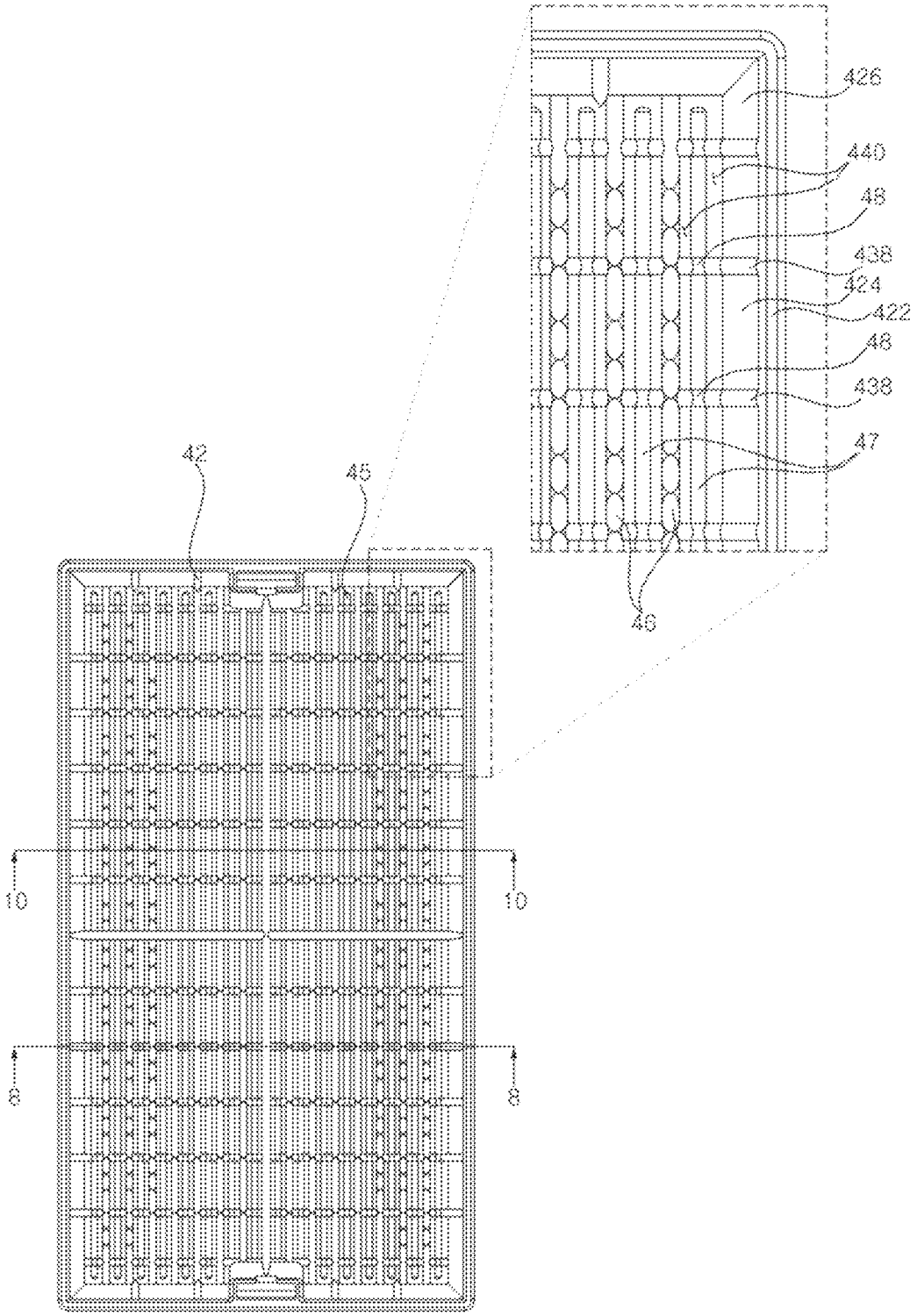

【Fig. 7】
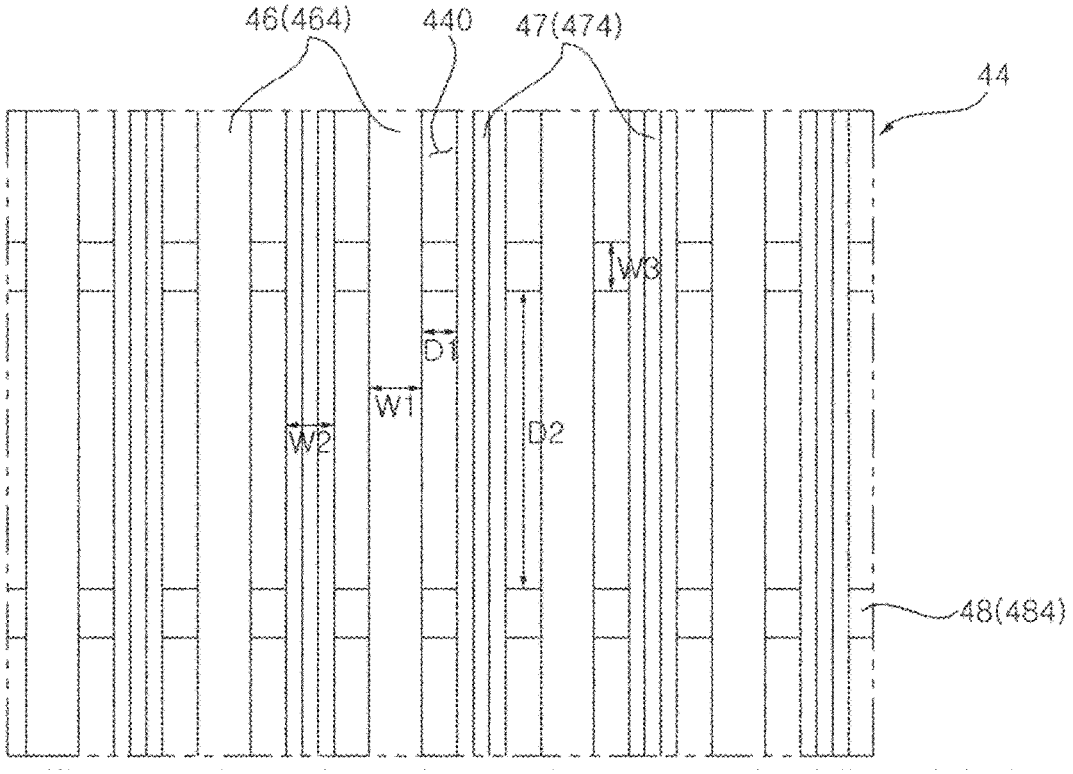

【Fig. 8】
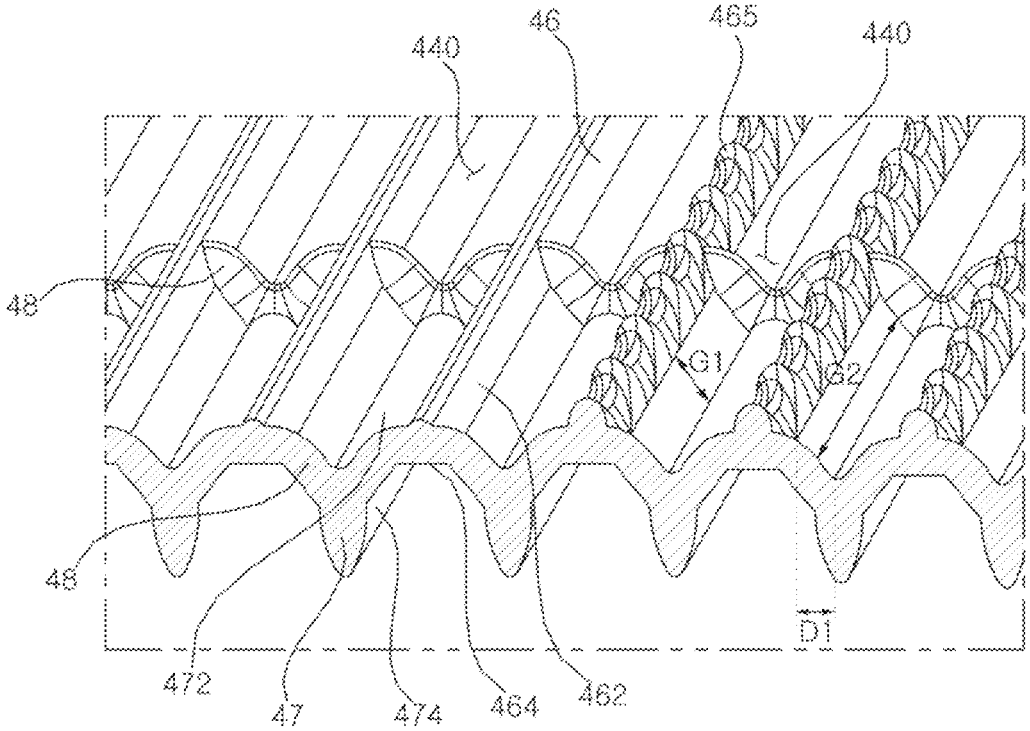

【Fig. 9】
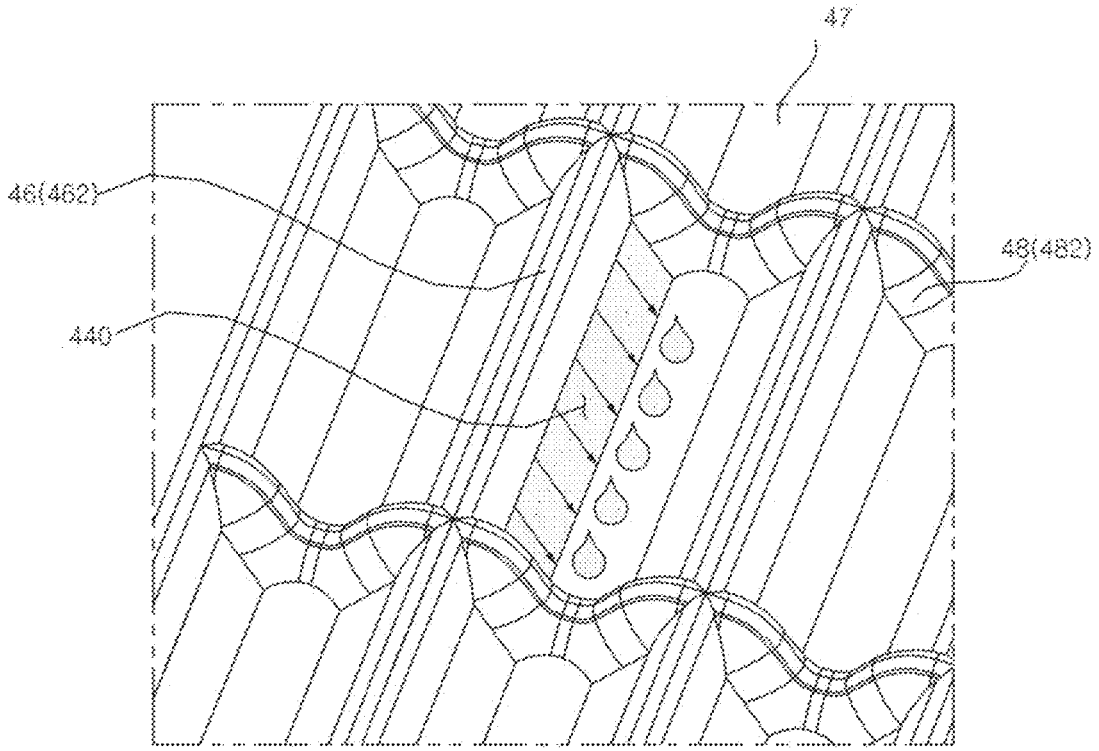

【Fig. 10】
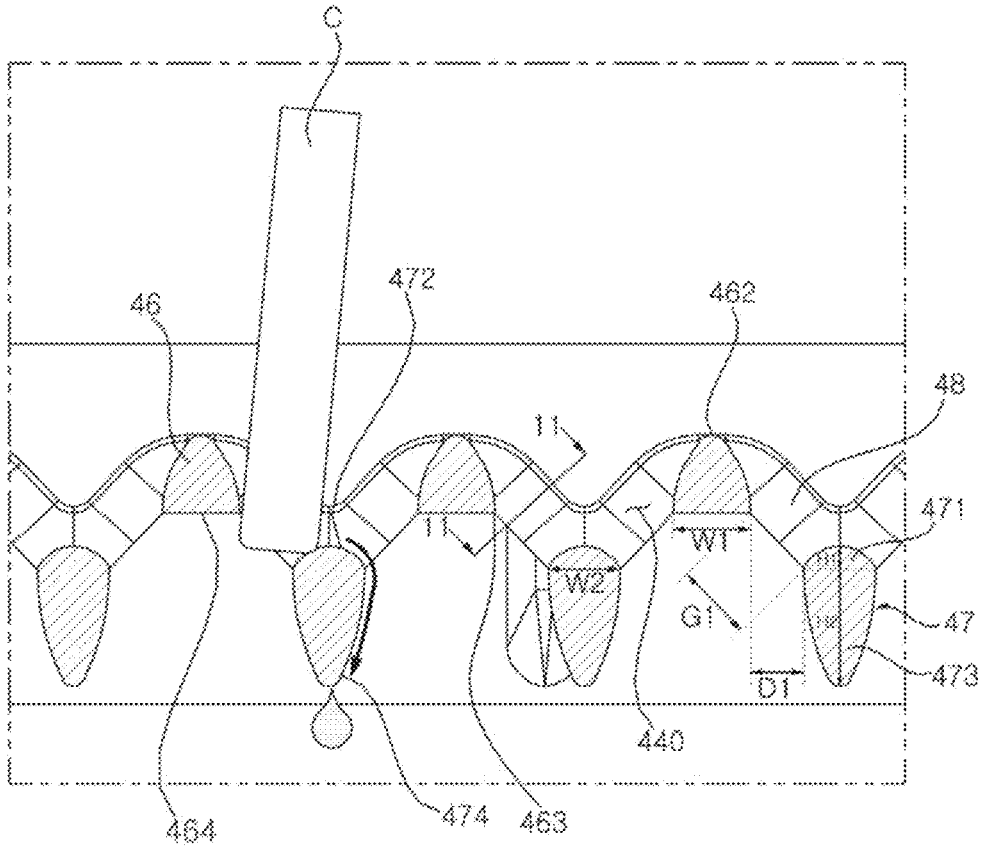

【Fig. 11】
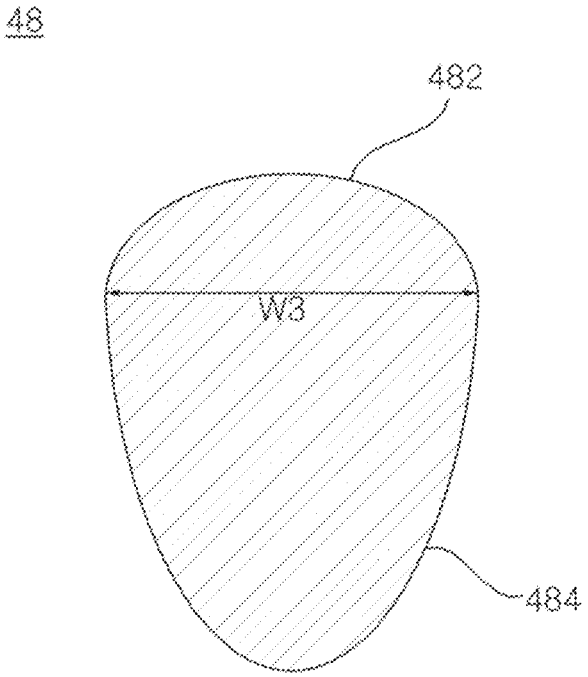

【Fig. 12】
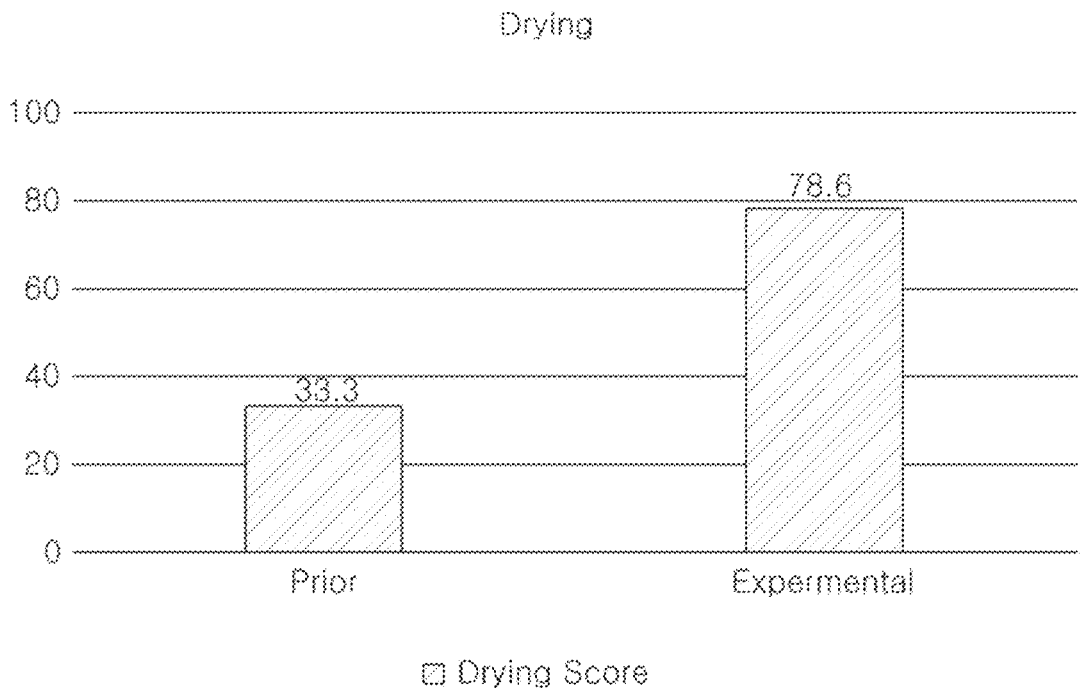

【Fig. 13】
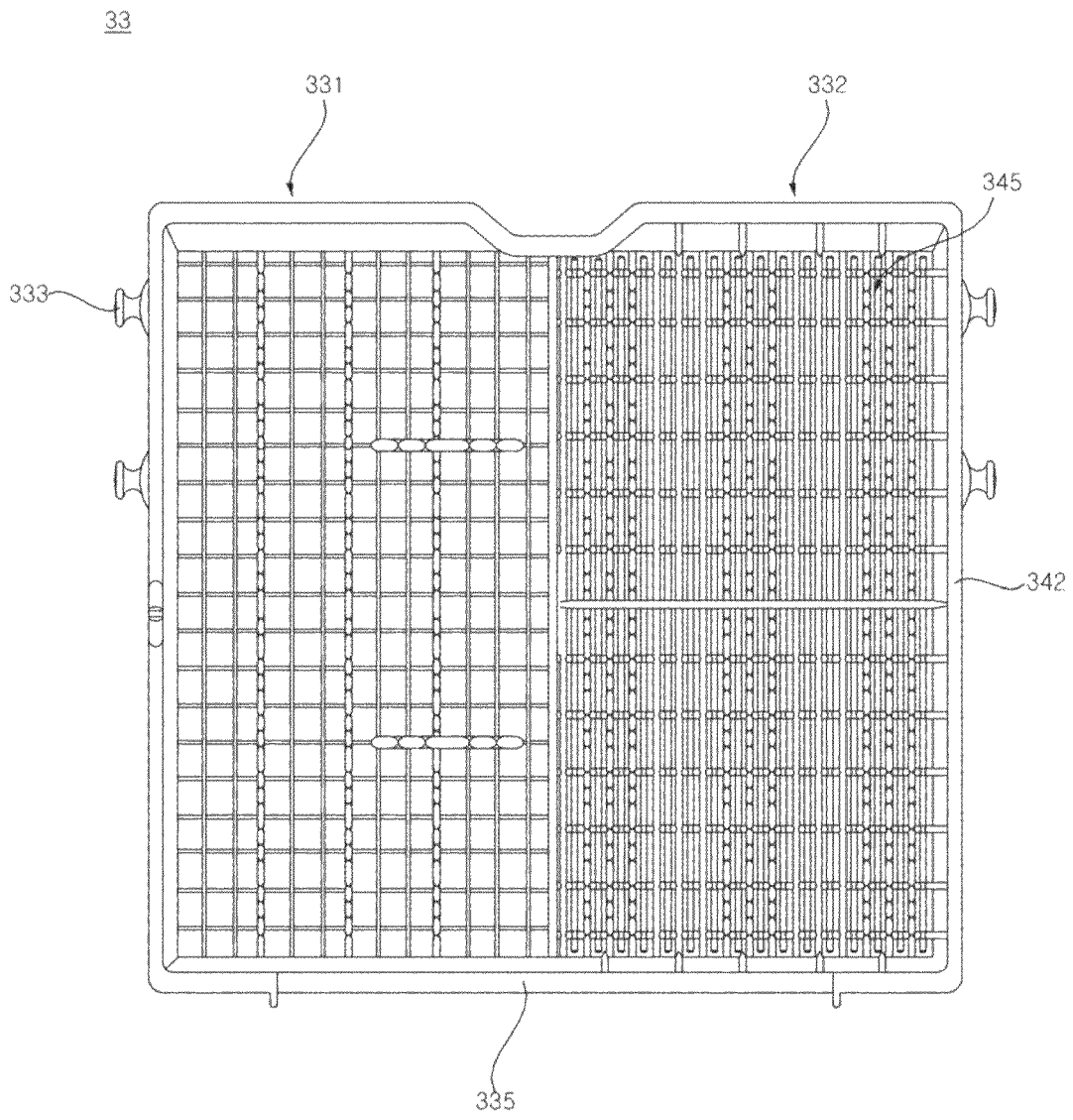

【Fig. 14】
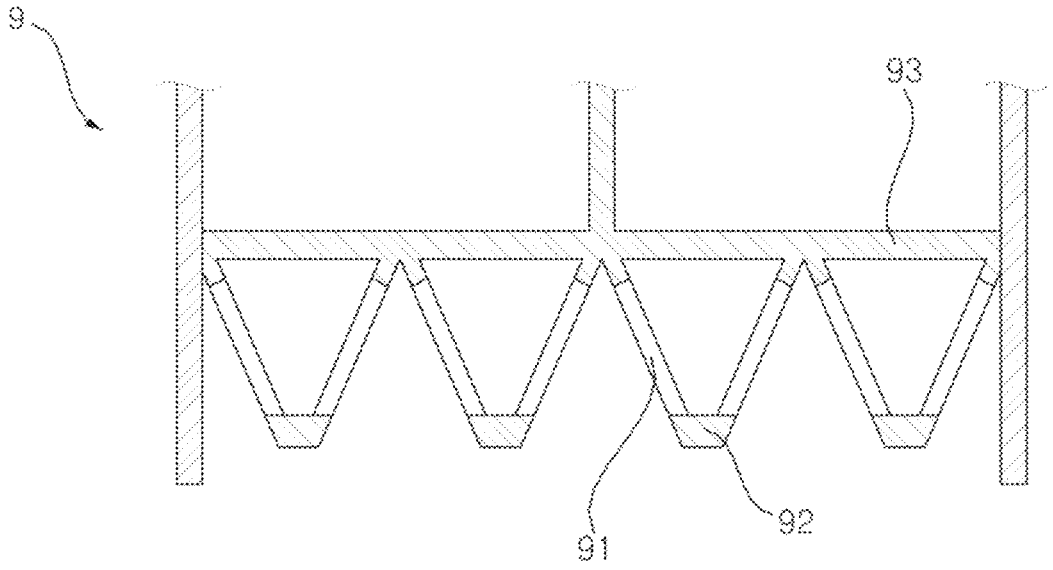

【Fig. 15】
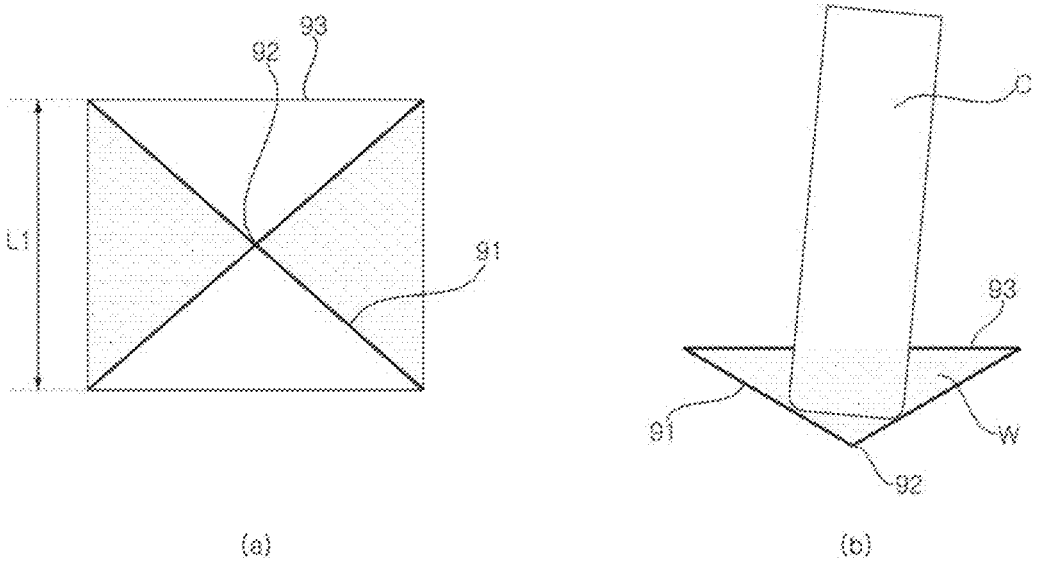

【Fig. 16】
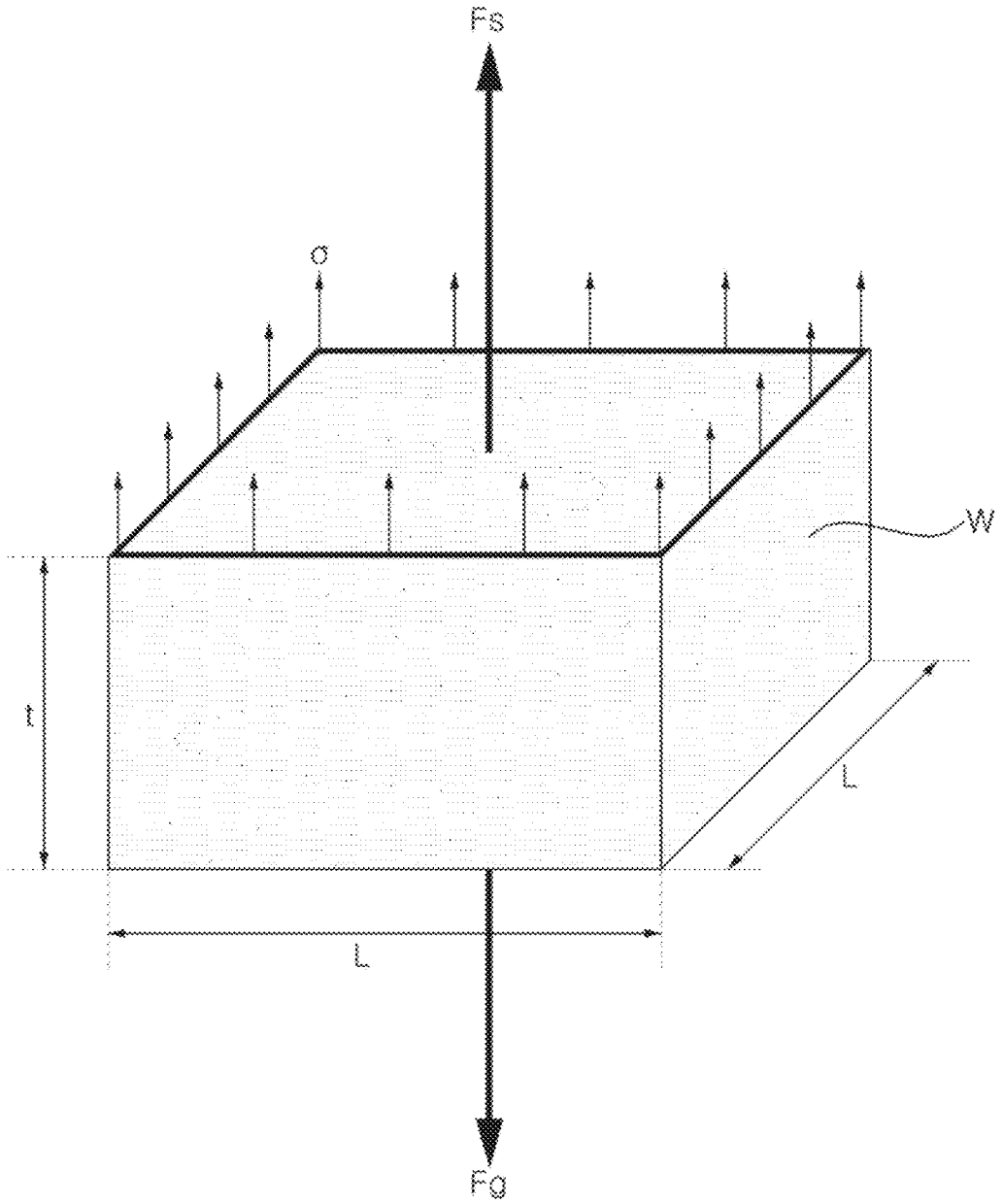

【Fig. 17】
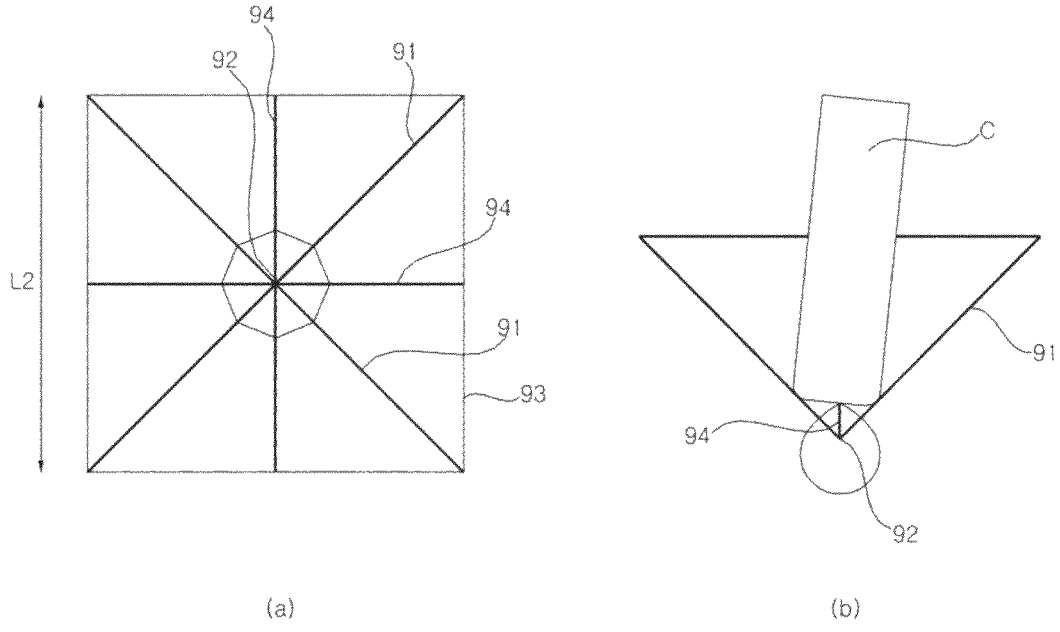

CUTLERY RACK AND DISHWASHER INCLUDING THE SAME

CROSS-REFERENCE TO RELATED APPLICATION

The present application claims priority under 35 U.S.C. 119 to Korean Patent Application No. 10-2022-0179214, filed on Dec. 20, 2022, which is hereby incorporated by reference in its entirety.

TECHNICAL FIELD

This disclosure relates to a dishwasher, and more particularly, to a dishwasher including a cutlery rack.

BACKGROUND

A dishwasher is a home appliance that sprays washing water to remove dirt such as food residue from dishes such as bowls and plates, or cutlery such as spoons, chopsticks, and forks, and to wash dishes or spoons (hereinafter, referred to as 'washing object').

A rack on which a washing object is placed is disposed in a washing space inside a dishwasher, and washing water is sprayed from a nozzle disposed in the lower and/or upper side of the rack. The nozzle is provided on a rotating spray arm to spray washing water over a wide area.

Since spoons are generally smaller than dishes, dishwashers that are equipped with means for holding spoons separately from a rack for holding the dishes are being released.

The means for holding spoons may be slidably supported on a tub that provides a washing space, or may be mounted on a rack that holds dishes.

Public Utility Model Publication No. 20-1998-0056456 (hereinafter referred to as 'Utility 456') discloses a cutlery basket for a dishwasher. The cutlery basket includes a bottom portion having a cross-sectional shape of a triangular wave to effectively discharge food waste and facilitate placing of cutlery.

FIGS. 14 and 15 show a cutlery rack similar to the above Utility '456. FIG. 14 is a cross-sectional view of a conventional cutlery rack 9, and FIG. 15 is a bottom view (a) and a schematic diagram (b) of the conventional cutlery rack 9.

Referring to FIGS. 14 and 15, the conventional cutlery rack 9 includes a lattice-shaped rib 93 forming a square hole and a diagonal rib 91 provided within the square hole. A spoon C is supported at an intersection where a pair of diagonal ribs 91 meet.

If the size of the hole formed by the lattice-shaped rib 93 and the diagonal ribs 91 is large, the chopsticks C may be dropped.

Therefore, in order to prevent the chopsticks C from dropping, the size of the hole L1 may be set small.

FIG. 16 is a free body diagram to explain the reason why water condensed on the rib does not fall and forms a water film in a hole, and shows a gravity Fg and a surface tension Fs that act on the water W forming the water film.

In a state where water does not fall and forms a water film, the surface tension Fs acting on the water is in equilibrium with gravity Fg. Referring to FIG. 16, when the force acting on the water is in equilibrium, the following equation may be established.

$$F_s = F_g$$

$$\sigma \cdot 4L = \rho \cdot L^2 t \cdot g$$

From this, it can be seen that the condition for reducing the water film formed in the hole is as follows.

$$\sigma \cdot 4L < \rho \cdot L^2 t \cdot g$$

That is, as the perimeter or size of the hole becomes smaller, it is more likely that water will accumulate on the bottom of the cutlery rack.

Therefore, in order to prevent the problem of dropping the chopsticks C, if the size of the hole is reduced, water may accumulate between the ribs.

To prevent this problem, as shown in FIG. 17, it may be considered to add a rib 94 to the cutlery rack 9. Even if the length L2 of one side of the lattice-shaped rib 93 is set to be greater than the length L1 of one side of the lattice-shaped ribs 93 of the cutlery rack 9 shown in FIGS. 14 and 15, the additional rib 94 may prevent the chopsticks from dropping.

However, in this case, water is likely to accumulate at the intersection 92 due to the additional rib 94.

As described above, if water W accumulates at the bottom of the cutlery rack, water may remain on the cutlery after a washing and/or drying cycle is completed.

In addition, water marks may remain on the spoon placed on the cutlery rack.

SUMMARY

The disclosure has been made in view of the above problems, and may provide a cutlery rack for holding spoons and a dishwasher including the same.

The disclosure may further provide a dishwasher having a cutlery rack that prevents chopsticks from dropping.

The disclosure may further provide a dishwasher that reduces the water remaining in a cutlery rack.

The disclosure may provide a dishwasher that reduces the water remaining in a cutlery after a cycle is terminated.

The disclosure may provide a dishwasher that doesn't leave water marks after the cutlery is dried.

The disclosure may further provide a dishwasher with a cutlery rack that has a structure in which water is guided downward and easy for water to fall.

The disclosure may further provide a dishwasher in which a water film is easily removed, even if a water film is formed in a hole at the bottom of the cutlery rack.

The disclosure may further provide a dishwasher in which water condensed on the side surface of a cutlery rack can easily fall from the cutlery rack.

The disclosure may further provide a dishwasher that prevents water film from being formed, even at the edges of the bottom of the cutlery rack.

In accordance with an aspect of the present disclosure, a dishwasher includes a tub providing a washing chamber, and a cutlery rack disposed in the washing chamber.

The cutlery rack may be configured to store cutlery.

The cutlery rack may include a plurality of bars.

The cutlery rack may have a plurality of holes. The plurality of holes may be provided between the plurality of bars.

The plurality of bars may be referred to as bottom muntin. The bottom muntin may provide the plurality of holes.

The plurality of bars may include a first bar and a second bar.

There may be provided a plurality of first bars. The plurality of first bars may be arranged parallel to each other.

The second bar may extend along the direction in which the plurality of first bars are arranged. The second bar may extend in the direction in which the plurality of first bars are arranged.

The second bar may connect the first bars.

There may be provided a plurality of second bars. The plurality of second bars may be arranged along the longitudinal direction of the first bar. The plurality of second bars may be arranged parallel to each other.

The gap between the plurality of first bars may be smaller than the gap between the plurality of second bars. The gap between two adjacent first bars among the plurality of first bars may be smaller than the gap between two adjacent second bars among the plurality of second bars.

The length of the hole formed between the plurality of bars may be longer than the width. The hole may be a parallelogram in which one side is longer than the other side. The hole may be a rectangle having one side longer than the other side.

The first bar may include an upper bar and a lower bar.

There may be provided a plurality of upper bars. The upper bars may be arranged parallel to each other.

The lower bar may be disposed between the upper bars. The lower bar may be disposed between the upper bars in the direction in which the first bar is arranged (or the direction in which the upper bar is arranged).

The lower bar may be disposed lower than the upper bar.

There may be provided a plurality of lower bars.

The upper bar and the lower bar may be arranged alternately. The plurality of upper bars and the plurality of lower bars may be arranged alternately with each other.

A first horizontal distance between the upper bar and the lower bar may be smaller than a second horizontal distance between the second bars.

The first horizontal distance may be smaller than the width of the first bar. The first horizontal distance may be smaller than the width of the second bar.

The lower bar may include an upper portion and a lower portion.

The upper portion of the lower bar may provide an upper surface facing upward.

The lower portion of the lower bar may extend downward from the upper portion of the lower bar. The lower portion may provide a lower surface that faces downward.

In the up-down direction, the length of the lower portion of the lower bar may be longer than the length of the upper portion of the lower bar.

The lower portion of the lower bar may have a width that narrows downward.

The upper bar may include an upper surface facing upward. The upper surface of the upper bar may be inclined with respect to the horizontal. The upper surface of the upper bar may be convex upward toward the center of the width direction.

The lower bar may include an upper surface facing upward. The upper surface of the lower bar may be inclined with respect to the horizontal. The upper surface of the lower bar may be convex upward toward the center of the width direction.

The slope of the upper surface of the upper bar may be steeper than the slope of the upper surface of the lower bar. The height between the upper and lower ends of the upper surface of the upper bar is greater than the height between the upper and lower ends of the upper surface of the lower bar.

The upper bar may include a lower surface facing downward.

The lower surface of the upper bar may be disposed higher than the lower bar.

The upper bar may have a corner where the upper surface and the lower surface meet. The corner may be disposed closer to the lower bar than other portion of the upper bar.

The lower surface of the upper bar is horizontal.

The second bar may include an upper portion and a lower portion.

The upper portion of the second bar may provide an upper surface facing upward. The upper portion of the second bar may have a width that increases downward.

The lower portion of the second bar may provide a lower surface facing downward. The lower portion of the second bar may have a width that narrowing downward.

The height of the lower portion of the second bar may be greater than the height of the upper portion of the second bar.

The cutlery rack may include a lower rim surrounding the plurality of bars. The lower rim may form an edge of the plurality of bars (or bottom muntin).

At least one first bar among the plurality of first bars may be spaced apart from the lower rim.

The upper bar may be connected to the lower rim. The lower bar may be spaced apart from the lower rim.

The lower bar may extend parallel to the upper bar. The lower bar may be disposed lower than the upper bar.

The cutlery rack may include a net forming a side surface of the cutlery rack.

The net may include a third bar and a fourth bar.

The third bar may be referred to as a horizontal bar. The horizontal bar may extend horizontally. Alternatively, the horizontal bar may extend in a direction inclined with respect to the horizontal.

The fourth bar may be referred to as a vertical bar. The vertical bar may extend in the up-down direction.

The vertical bar may be connected to the second bar.

The cutlery rack may include a frame. The frame may include the lower rim. The frame may include an upper rim disposed higher than the lower rim. The frame may include a column that connects the upper rim and the lower rim.

The net may be disposed between the upper rim and the lower rim.

The upper rim, the lower rim, and the column may surround the net. The upper rim, the lower rim, and the column may form an edge of the net.

According to an aspect of the present disclosure, a dishwasher may include a first rack that is able to be pulled from the washing chamber.

The cutlery rack may be placed in the first rack.

Alternatively, the cutlery rack may be disposed to be able to be pulled from the washing chamber. The cutlery rack may be disposed to be able to be pulled from the washing chamber independently of the first rack.

According to an aspect of the present disclosure, a dishwasher may include a spray unit that sprays washing water. The spray unit may be disposed in the washing chamber.

Specific details of other embodiments are included in the detailed description and drawings.

BRIEF DESCRIPTION OF THE DRAWINGS

The above and other objects, features and advantages of the present invention will be more apparent from the following detailed description in conjunction with the accompanying drawings, in which:

FIG. 1 is a perspective view of a dishwasher according to an embodiment of the present disclosure;

FIG. 2 is a perspective view showing a state where a door of dishwasher is opened according to an embodiment of the present disclosure;

FIG. 3 is a schematic diagram showing an interior of a dishwasher according to an embodiment of the present disclosure;

FIG. 4 is a schematic diagram showing a cutlery rack and a first rack of a dishwasher according to an embodiment of the present disclosure;

FIG. 5 is a perspective view of a cutlery rack of a dishwasher according to an embodiment of the present disclosure;

FIG. 6 is a plan view of the cutlery rack shown in FIG. 5;

FIG. 7 is a partial bottom view of the cutlery rack shown in FIG. 5;

FIG. 8 is a cross-sectional perspective view of the cutlery rack shown in FIG. 6;

FIG. 9 is an enlarged view showing a bottom of the cutlery rack shown in FIG. 6;

FIG. 10 is a cross-sectional view of the cutlery rack shown in FIG. 6;

FIG. 11 is a cross-sectional view of a second bar shown in FIG. 10;

FIG. 12 is a graph of drying performance for spoon of a dishwasher according to an embodiment of the present disclosure;

FIG. 13 is a plan view of a cutlery rack for a dishwasher according to an embodiment of the present disclosure;

FIG. 14 is a cross-sectional view of a conventional cutlery rack;

FIG. 15 is a bottom view A and a schematic view B of a conventional cutlery rack;

FIG. 16 is a free body diagram showing a surface tension and a gravity acting on water; and FIG. 17 is a bottom view A and a schematic view B of a conventional cutlery rack.

DETAILED DESCRIPTION

Description will now be given in detail according to exemplary embodiments disclosed herein, with reference to the accompanying drawings. For the sake of brief description with reference to the drawings, the same or equivalent components may be denoted by the same reference numbers, and description thereof will not be repeated.

In general, suffixes such as "module" and "unit" may be used to refer to elements or components. Use of such suffixes herein is merely intended to facilitate description of the specification, and the suffixes do not have any special meaning or function.

In the present disclosure, that which is well known to one of ordinary skill in the relevant art has generally been omitted for the sake of brevity. The accompanying drawings are used to assist in easy understanding of various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are only used to distinguish one element from another.

It will be understood that when an element is referred to as being "connected with" another element, there may be intervening elements present. In contrast, it will be understood that when an element is referred to as being "directly connected with" another element, there are no intervening elements present.

A singular representation may include a plural representation unless context clearly indicates otherwise.

Referring to FIG. 1, a dishwasher includes a tub 10. The tub 10 may provide a washing chamber 11. The washing chamber 11 may be provided inside the tub 10.

The tub 10 may include a bottom 12 (see FIG. 3) that provides a bottom surface of the washing chamber 11.

The tub 10 may include a side wall 15 that is connected to the bottom 12 and extends upward. The side wall 15 may be provided in a pair. A pair of side walls 15 may be spaced apart from each other. The direction in which the pair of side walls 15 are spaced apart may be referred to as a width direction of the washing chamber 11.

The tub 10 may include an upper surface 14 that provides a ceiling of the washing chamber 11. The upper surface 14 may be connected to a side wall. The upper surface 14 may connect a pair of side walls.

The tub 10 may include a rear wall 16 (see FIG. 3) that is connected to the bottom 12 and extends upward.

The tub 10 may have a hexahedral shape with one side open. The front of the tub 10 may be open.

The washing chamber 11 may be opened in a forward direction (see FIG. 2). The direction from the opening of the washing chamber 11 toward the rear wall (i.e., front-rear direction) may be referred to as a depth direction of the washing chamber 11.

The dishwasher may include a door 23 that opens and closes the washing chamber 11. The door 23 may be provided in the front of the tub 10. The door 23 may be rotatably coupled to the front of the tub 10.

The lower portion of the door 23 may be coupled to the tub 10. The door 23 may be hinged to the front lower portion of the tub 10. The upper portion of the door 23 may be opened to face the front of the door 23 (see FIG. 2).

The door 23 may include a door handle 235. The door handle 235 may be provided in the upper portion of the door 23.

A handle groove 237 may be provided in the lower side of the door handle 235. The handle groove 237 may extend in the width direction of the door 23 (width direction of the washing chamber).

The dishwasher may include a base 25. The base 25 may provide a bottom surface of the dishwasher.

The bottom 12 of the tub 10 may be spaced upward from the base 25. A space 26 may be provided between the bottom 12 of the tub 10 and the base 25. Components such as a PCB 27 (or controller), a sump 60, a pump 63 and the like, which will be described later, may be disposed in the space. Hereinafter, the space 26 is referred to as a machine room 26.

An interface 28 may be provided in the upper side of the door 23. The interface 28 may be disposed in the upper side of the door.

The interface 28 may receive commands from a user. The interface 28 may provide information related to the dishwasher to a user.

For example, a user may input commands related to a washing cycle and options through the interface 28. For example, the interface 28 may display information related to a cleaning cycle and options.

A controller 27 may control the dishwasher. The controller 27 may receive commands from a user through the interface 27. The controller 27 may provide information related to the dishwasher to a user through the interface 27.

Hereinafter, configurations described later may be controlled by the controller 27.

Referring to FIG. 2, the dishwasher may further include a casing 21. The casing 21 may be disposed outside the tub 10.

The casing 21 may include a cabinet 211 and a top plate 213. The cabinet 211 may cover the side wall 15 of the tub 10. The top plate 213 may cover the upper surface 14 of the tub 10.

As described above, the washing chamber 11 may be opened in a forward direction, and the door 23 may open and close the washing chamber 11.

The dishwasher may include a rack 30 disposed in the washing chamber 11. Washing objects such as dishes, cutlery, and/or cooking utensils may be placed on the rack 30.

The rack 30 may include a first rack 31. The first rack 31 may be disposed in the lower portion of the washing chamber 11. The first rack 31 may be disposed on the bottom 12 of the washing chamber. Alternatively, the first rack 31 may be disposed above the bottom 12.

The rack 30 may include a second rack 32. The second rack 32 may be disposed above the first rack 31. The second rack 32 may be disposed at a height in the middle portion of the washing chamber 11. The height of the position where the second rack 32 is disposed may be adjusted.

The dishwasher may include a spray unit 50. The spray unit 50 may be disposed below the rack 30. The spray unit 50 may spray washing water toward the upper side.

The spray unit 50 may include a first spray arm 51. The first spray arm 51 may be disposed below the first rack 31.

The spray unit 50 may include a second spray arm 52. The second spray arm 52 may be disposed below the second rack 32.

The door 23 may include a door cover 233. The door cover 233 may face downward when the door 23 is open.

The door 23 may include an inner panel 231. The door panel 231 may face upward when the door 23 is open. When a user places a washing object on the rack, water falling from the washing object or the rack may fall onto the inner panel 231.

The dishwasher 11 may include a steam nozzle 57. The steam nozzle 57 may be provided in the door 23. The steam nozzle 57 may be provided in the inner panel 231.

The dishwasher may include a dispenser 24. The dispenser 24 may contain detergent. The dispenser 24 may contain a tablet-type detergent. The dispenser 24 may contain a powder-type detergent.

Referring to FIG. 3, the rack 30 may be provided to be movable in the depth direction of the washing chamber 11. The rack 30 may be slidable. The rack 30 may be pulled forward from the washing chamber 11. The rack 30 may be retracted to the rear and disposed in the washing chamber 11.

The first rack 31 may be slidably supported on the side wall 15. The first rack 31 may be slidably supported on a rail provided on the side wall 15.

The height of a position where the second rack 32 is disposed may be adjusted. For example, a plurality of rails supporting the second rack 32 may be provided, and the plurality of rails may be disposed at different heights.

The dishwasher may include a cutlery rack 40. The cutlery rack 40 may be disposed in the washing chamber 11. The cutlery rack 40 may store cutlery such as spoons, chopsticks, forks, and knives. In addition, the cutlery rack 40 may store cooking utensils. Hereinafter, spoons will be explained as an example.

The cutlery rack 40 may include a bottom having a plurality of holes. Through this, spoons may be placed on the cutlery rack 40.

In addition, the cutlery rack 40 may have a side surface extending upward from the bottom. Through this, spoons may be placed on the cutlery rack 40 in an upright state.

The cutlery rack 40 may be disposed in the first rack 31. The cutlery rack 40 may be placed on the first rack 31.

The rack 30 may include a third rack 33. The third rack 33 may be disposed on the upper side of the first rack 31. The third rack 33 may be disposed on the upper side of the second rack 32. The third rack 33 may be disposed on the uppermost side of the plurality of racks 30.

The third rack 33 may be slidably supported on the side wall 15. The second rack 32 may be slidably supported on a rail provided on the side wall 15.

The third rack 33 may have a height between the upper end and the lower end which is lower in comparison with the first and second racks 33.

The third rack 33 may be configured to hold spoons. Therefore, the third rack 33 may be referred to as a cutlery rack 33.

The third rack 33, like the cutlery rack 40, may store cutlery such as spoons, chopsticks, forks, and knives and cooking utensils.

The spray unit 50 may include nozzles 513, 523, and 53 (see FIG. 3). The nozzles 513, 523, and 53 may spray washing water.

The spray unit 50 may be rotatably provided.

The first spray arm 51 may be provided on the bottom 12. The first spray arm 51 may be disposed in the lower side of the first rack 31. The first spray arm 51 may spray washing water toward the first rack 31. The first spray arm 51 may spray washing water toward the cutlery rack 40.

The first spray arm 51 may include a first nozzle 513. A plurality of first nozzles 513 may be provided. Washing water may be sprayed from the first nozzle 513.

The first spray arm 51 may be rotatably provided. The first spray arm 51 may be rotated by a motor. Alternatively, the first spray arm 51 may be rotated by the reaction force of the force of washing water sprayed from the first nozzle 513.

The second spray arm 52 may be disposed in the lower side of the second rack 32. The second spray arm 52 may be coupled to the second rack 32. The second spray arm 52 may spray washing water toward the second rack 32.

The second spray arm 52 may include a second nozzle 523. A plurality of second nozzles 523 may be provided. Washing water may be sprayed from the second nozzle 523.

The second spray arm 52 may be rotatably provided. The second spray arm 52 may be rotated by the reaction force of the force of washing water sprayed from the second nozzle 523. Alternatively, the second spray arm 52 may be rotated by a motor.

The spray unit 50 may include a top nozzle 53. The top nozzle 53 may be disposed in the upper side of the rack 30. The top nozzle 53 may be provided on the ceiling 14 of the washing chamber 11. The top nozzle 53 may spray washing water downward. The top nozzle 53 may spray washing water toward the rack 30. The top nozzle 53 may spray washing water toward the third rack 33.

The door 23 may include a door cover 233. The door cover 233 may face forward in a state where the door 23 closes the washing chamber 11. In a state where the door 23 closes the washing chamber 11, the door cover 233 may be exposed to the outside.

The door 23 may include an inner panel 231. In a state where the door 23 closes the washing chamber 11, the inner panel 231 may face the washing chamber 11. In a state where the door 23 closes the washing chamber 11, the inner panel 231 may provide the front surface of the washing chamber 11.

The dishwasher may supply steam to the washing chamber 11.

The steam nozzle 57 may supply steam to the washing chamber 11. The steam nozzle 57 may be provided in the front of the washing chamber 11 and may supply steam toward the rear. The steam nozzle 57 may be provided in the lower portion of the washing chamber 11 and may supply steam toward the upper side. The steam nozzle 57 may be provided in the front lower portion of the washing chamber 11 and may supply steam toward the upper rear side.

The steam nozzle 57 may be provided in the door 23. The steam nozzle 57 may be provided in the inner panel 231. The steam nozzle 57 may be provided in the lower side portion of the inner panel 231. The steam nozzle 57 may be provided in an inclined surface 232 (see FIG. 7) of the inner panel 231.

The dishwasher may include a sump 60. The sump 60 may receive water from an external water source such as a tap. The sump 60 may store water supplied from the outside.

The sump 60 may receive water from an external water source through a water supply pipe 71. The water supply pipe 71 may be connected to an external water source. The water supply pipe 71 may connect the external water source and the sump 60.

A water supply valve 72 may shut off the water supply pipe 71. The water supply valve 72 may control the flow of water from an external water source to the sump 60.

The sump 60 may be disposed in the lower side of the tub 10. The sump 60 may be disposed in the lower side of the bottom 12 of the tub 10. The sump 60 may be disposed in the machine room 26. The sump 60 may be connected to the bottom 12 of the tub 10 and may be disposed in the machine room 26.

The sump 60 may store water drained from the washing chamber 11.

The dishwasher may include a filter 68. The filter 68 may filter out foreign matter from water flowing from the washing chamber 11 to the sump 60. The filter 68 may be disposed in the sump. The filter 68 may be provided in the bottom 12 of the washing chamber 11.

The dishwasher may include a pump 63 that supplies washing water to the washing chamber 11. The pump 63 may pump water from the sump 60. The pump 63 may pump water and supply it to the spray unit 50.

The pump 63 may include an impeller 633, a pump housing 64 that accommodates the impeller 633, and a washing motor 631 that rotates the impeller 633.

The dishwasher may include a heater 66 that heats washing water. The heater 66 may be connected to the pump 63. The heater 66 may heat water flowed into the pump 63.

Alternatively, the heater 66 may be provided separately from the pump 63. The heater 66 may heat water pumped from the pump 63. Alternatively, the heater 66 may be provided between the sump 60 and the pump 63 to heat the water flowing into the pump 63.

A switching valve 75 may be connected to the washing pump 63. The switching valve 75 may receive washing water from the pump 64.

The switching valve 75 may be coupled to a valve coupling portion 76.

The valve coupling portion 76 may be provided in the sump 60. The valve coupling portion 76 may constitute the lower portion of the switching valve 75. The valve coupling portion 76 may be connected to the pump 63.

The switching valve 75 may be connected to the spray unit 50.

The switching valve 75 may distribute washing water. The switching valve 74 may selectively supply washing water to at least one of the first spray arm 51, the second spray arm 52, and the top nozzle 53.

A pump inlet pipe 73 may connect the sump 60 and the pump 63. When the pump 63 operates, water in the sump 60 may flow into the pump 63 through the inlet pipe 73.

A discharge pipe 74 may be connected to the pump 63. The discharge pipe 74 may guide water discharged from the pump 63 toward the spray unit 50.

The discharge pipe 74 may be connected to the switching valve 75. The discharge pipe 74 may be connected to the valve coupling portion 76.

The discharge pipe 74 may connect the pump 63 and the switching valve 75.

Connection pipes 751, 752, and 753 may connect the spray unit 50 to the switching valve 75.

The connection pipes 751, 752, and 753 may include a first connection pipe 751 connected to the first spray arm 51. The first connection pipe 751 may be provided inside the first spray arm 51.

The connection pipes 751, 752, and 753 may include a second connection pipe 752 connected to the second spray arm 52. The second connection pipe 752 may be provided on the rear wall of the tub 10.

The connection pipes 751, 752, and 753 may include a third connection pipe 753 connected to the top nozzle 53. The third connection pipe 753 may be provided on the upper surface 14 of the tub 10.

When the pump 63 operates, the washing water discharged from the pump 63 may flow into the switching valve 64. The washing water flowing into the switching valve 64 may flow into at least one connection pipe among a plurality of connection pipes 751, 752, and 753 by the switching valve 64.

When the washing water flows into the first connection pipe 751, the washing water may be sprayed from the nozzle 513 of the first spray arm 51.

When the washing water flows into the second connection pipe 752, the washing water may be sprayed from the nozzle 523 of the second spray arm 52.

When the washing water flows into the third connection pipe 753, the washing water may be sprayed from the top nozzle 53.

The washing water sprayed into the washing chamber 11 may be collected at the bottom 12 and flow into the sump 60. The washing water flowing into the sump 60 may be sprayed into the washing chamber by the pump 63, and may circulate again.

The sump 60 may be connected to a drain pump 78. A drain pipe 79 may connect the sump 60 and the drain pump 78.

When the drain pump 78 operates, water in the sump 60 may be drained to the outside of the dishwasher.

Referring to FIG. 4, the cutlery rack 40 may be disposed in the first rack 31. The cutlery rack 40 may be disposed in the second rack 32.

Dishes may be stored in the rack 30. Dishes may be stored in the first rack 31. Dishes may be stored in the second rack 32.

The cutlery rack 40 can be placed in the first rack 31 along with dishes.

Referring to FIG. 5, the cutlery rack 40 may include a bottom 44. A detailed description of the bottom of the cutlery rack 44 will be described later. The cutlery rack 40 may include a basket 41. The basket 41 may include a bottom 44. The basket 41 may include a frame 42. The frame 42 may include a lower rim 424 that forms an edge of the bottom 44. The lower rim 424 may surround a bottom muntin 45 described later. The lower rim 424 may provide an edge of the bottom muntin 45.

The lower rim 424 may include a protrusion 425 that protrudes downward. The protrusion 425 may be provided at a portion corresponding to the vertex of the lower rim 424. In addition, the protrusion 425 may be provided at a center portion of the lower rim 424.

The cutlery rack 40 may be disposed in the rack 30. The cutlery rack 40 may be stably placed on the rack 30 through the protrusion 425.

The frame 43 may include an upper rim 422 disposed above the lower rim 424. The lower rim 424 and the upper rim 422 may have a rectangular shape.

The frame 43 may include a column 426 connecting the upper rim 422 and the lower rim 424. The column 426 may extend along the up-down direction.

The column 426 may extend upward from the lower rim 424. The column 426 may extend upward from a position corresponding to the vertex of the lower rim 424. The column 426 may be connected to a portion corresponding to the vertex of upper rim 422.

The basket 41 may include a net 43 forming the side surface of the cutlery rack 40. The net 43 may be disposed between the upper rim 422 and the lower rim 424.

The upper rim 422, the lower rim 424, and the column 46 may surround the net 43. The upper rim 422, the lower rim 424, and the column 46 may form the edge of the net 43.

The net 43 may include a horizontal bar 436 and a vertical bar 438.

The horizontal bar 436 may extend horizontally. Alternatively, the horizontal bar 436 may extend in an inclined direction with respect to the horizontal.

The horizontal bar 436 may include a plurality of horizontal bars 436 disposed parallel to each other. The plurality of horizontal bars 436 may be arranged in the up-down direction.

The vertical bar 438 may extend in the up-down direction. The vertical bar 438 may connect a plurality of horizontal bars 436. The vertical bar 438 may be connected to the horizontal bar 436 in the inner direction of the basket.

The vertical bar 438 may be connected to a second bar 48 of the bottom muntin 45 described later.

Accordingly, water droplets on the side surface of the cutlery rack 40 may easily move to the bottom of the cutlery rack 40. In addition, the water that moves to the bottom may be guided to the second bar 43. The water guided to the second bar 43 may easily fall downward due to the structure of the second bar 43.

The cutlery rack 40 may further include a partition plate 49 disposed inside the basket 41. The partition plate 49 may divide a space inside the cutlery rack 40 into a plurality of spaces.

The cutlery rack 40 may include a handle 492. The handle 492 may be connected to the upper rim 422.

Referring to FIG. 6, the cutlery rack 40 may include a plurality of bars 45. A plurality of holes 440 may be provided between the plurality of bars 45.

The plurality of bars 45 may be called a bottom muntin 45. The bottom muntin 45 may provide a plurality of holes.

The bottom 44 of the cutlery rack 40 may include a plurality of bars 45 and a lower rim 424. The lower rim 424 may surround the plurality of bars 45.

The bottom 44 of the cutlery rack 40 may include a bottom muntin 45 and a lower rim 424. The lower rim 424 may surround the bottom muntin 45. The lower rim 424 may provide an edge of the bottom muntin 45.

The bottom muntin 45 may include a first bar 46, 47. There may be provided a plurality of first bars 46 and 47. The plurality of first bars 46 and 47 may be arranged parallel to each other.

The first bar 46, 47 may include an upper bar 46 and a lower bar 47. The upper bar 46 may be disposed relatively higher than the lower bar 47 (see FIG. 8).

The upper bar 46 and the lower bar 47 may be arranged parallel to each other. The upper bar 46 and the lower bar 47 may extend in the same direction.

The bottom muntin 45 may include a second bar 48. The second bar 48 may extend along the direction in which the first bar 46, 47 is arranged. The second bar 48 may connect a plurality of first bars 46 and 47.

There may be provided a plurality of second bars 48. The plurality of second bars 48 may be arranged parallel to each other. The plurality of second bars 48 may be arranged in the longitudinal direction of the first bar 46, 47.

The vertical bar 438 may extend in the up-down direction. The vertical bar 438 may extend from the upper rim 422 to the lower rim 424.

The vertical bar 438 may be connected to the frame 42. The vertical bar 438 may be disposed on the inner side surface of the basket 41. The vertical bar 438 may be connected to the frame 42 on the inner side surface of the basket 41.

The vertical bar 438 may be connected to the second bar 48. Through this, the water flowing down along the vertical bar 438 may move to the second bar 48. Water moved to the second bar 48 may easily fall downward through the structure of the bottom muntin 45.

The hole 440 closest to the lower rim 424 in the longitudinal direction of the first bar 47, 47 may be shorter than the other holes. A water film is likely to form in these holes 440.

The lower bar 47 may be spaced apart from the lower rim 424. Through this, the holes in both sides of the lower bar 47 may be connected to each other. That is, the length of the hole may be expanded. Therefore, a water film may be easily prevented from being formed in the hole 440.

The upper bar 46 may be connected to the lower rim 424. The second bar 48 may be connected to the lower rim 424. Through this, even if the upper bar 47 is spaced apart from the lower rim 424, the bottom muntin 45 may be connected to the lower rim 424.

A structure in which the upper bar 46 is connected to the lower rim 424 and the lower bar 47, which is located lower than the upper bar 46, is spaced apart from the lower rim 424 is advantageous in preventing a water film from being formed in the hole located at the edge in comparison with a structure in which the upper bar 46 is spaced apart from the lower rim 424.

Referring to FIG. 7, the plurality of first bars 46 and 47 may be arranged parallel to each other. The plurality of first bars 46 and 47 may be spaced apart from each other.

There may be provided a plurality of upper bars 46. The lower bar 47 may be disposed between the plurality of upper bars 46.

There may be provided a plurality of lower bars 47. The upper bar 46 may be disposed between the plurality of lower bars 47.

The upper bar 46 and the lower bar 47 may be arranged alternately.

The upper bar 46 and the lower bar 47 may be spaced apart from each other. A hole 440 may be formed in a portion spaced between the upper bar 46 and the lower bar 47. The width may be defined as a gap G1 (see FIG. 8) between the upper bar 46 and the lower bar 47.

The plurality of second bars 48 may be spaced apart from each other. The length of the hole 440 may be defined as a gap G2 (see FIG. 8) between two adjacent second bars 48 among the plurality of second bars 48. The length G2 of the hole may be larger than the width G1 of the hole.

FIG. 7 is a bottom view of the cutlery rack 40, and a gap between the bottom muntins 45 shown represents a horizontal distance.

The horizontal distance D1 between the upper bar 46 and the lower bar 47 may be smaller than the horizontal distance D2 between two adjacent second bars 48 among the plurality of second bars 48.

The horizontal distance D1 between the upper bar 46 and the lower bar 47 may be smaller than the width W1 of the upper bar 46. The horizontal distance D1 between the upper bar 46 and the lower bar 47 may be smaller than the width W2 of the lower bar 47. The horizontal distance D1 between the upper bar 46 and the lower bar 47 may be smaller than the width W3 of the second bar 48.

Referring to FIG. 8, the lower bar 47 may be disposed between a plurality of upper bars 46 in the direction in which the first bar 46, 47 is arranged. The lower bar 47 may be located lower than the upper bar.

The gap G1 between the upper bar 46 and the lower bar 47 may be smaller than the gap G2 between adjacent second bars 48 among the plurality of second bars 48.

The gap G1 between the upper bar 46 and the lower bar 47 may be defined as the width of the hole. The gap G2 between the second bars 48 may be defined as the length G2 of the hole.

The width G1 of the hole may be smaller than the length G2 of the hole.

The horizontal distance D1 between the upper bar 46 and the lower bar 47 corresponds to the length of the orthogonal projection of the gap G1 between the upper bar 46 and the lower bar 47.

The gap G2 between the second bars 48 may be equal to the horizontal distance D2 between the second bars 48.

The upper bar 46 may include an upper surface 462 that faces upward. The upper surface 462 may be inclined with respect to the horizontal.

The upper bar 46 may include a lower surface 464 that faces downward. The lower surface 464 may have a horizontal shape.

The lower surface 464 of the upper bar 46 may be located higher than the lower bar 47.

The lower surface 464 of the upper bar 46 may be located higher than the upper surface 472 of the lower bar 47.

The lower bar 47 may include an upper surface 472 that faces upward. The upper surface 472 of the lower bar 47 may be inclined with respect to the horizontal.

The lower bar 47 may include a lower surface 474 that faces downward. The lower surface 474 of the lower bar 47 may be inclined with respect to the horizontal.

A detailed description of the upper and lower surfaces 462 and 464 of the upper bar 46 and the upper and lower surfaces 472 and 474 of the lower bar 47 will be described later with reference to FIG. 10.

The first bar 46, 47 may include a protrusion 465 that protrudes upward. This may prevent spoons placed on the cutlery rack 40 from moving in the longitudinal direction of the first bar 46, 47.

The protrusion 465 may be provided on the upper bar 46. The protrusion 465 may protrude from the upper surface 462 of the upper bar 46.

The protrusion 465 may be provided on at least one of the plurality of upper bars 46. The protrusion 465 may be provided on some upper bars 46 among the plurality of upper bars 46.

Referring to FIG. 9, the upper surface 462 of the upper bar 46 may be inclined with respect to the horizontal. The upper surface 462 of the upper bar 46 may be inclined to face downward as it progresses toward the edge.

Water that falls on the upper bar 46 may move to the edge of the upper bar 46. Water on the edge of the upper bar 46 may move to the lower bar 47. A water film may be formed in the hole 440 between the upper bar 46 and the lower bar 47.

The upper bar 46 may be located higher than the lower bar 47.

The water film formed in the hole 440 may be biased toward the lower bar 47 by gravity, and the water film may be removed.

Referring to FIG. 10, the upper surface 472 of the lower bar 47 may have a shape in which the central portion in the width direction of the lower bar 47 is convex upward. The upper surface 472 of the lower bar 47 may have an arc shape.

The lower surface 474 of the lower bar 47 may have a shape in which the central portion in the width direction of the lower bar 47 is convex downward.

The water on the lower bar 47 may move to the edge along the upper surface 472. The water that moved to the edge may move downward along the lower surface 474. The water collected at the lower end of the lower bar 47 may be separated from the lower bar 47 and fall downward.

The lower bar 47 may include an upper portion 471 and a lower portion 473.

The upper portion 471 of the lower bar 47 may provide an upper surface 472. The lower portion 472 of the lower bar 47 may provide a lower surface 472.

The width of the upper portion 471 of the lower bar 47 may become wider toward the lower side. The width of the lower portion 473 of the lower bar 47 may become narrower toward the lower side. The width W2 may be maximum at the boundary between the upper portion 472 and the lower portion 474.

The height H1 of the upper portion 471 of the lower bar 47 may be smaller than the height H2 of the lower portion 473 of the lower bar 47.

The lower surface 474 of the lower bar 47 may be inclined with respect to the horizontal. The slope of the lower surface 474 of the lower bar 47 may be steeper than the slope of the upper surface 472 of the lower bar 47.

The upper surface 462 of the upper bar 46 may become narrower toward the upper side. The upper surface 462 may be highest at the center portion of the upper bar 46 in the width direction.

The upper surface 462 may be inclined downward from the center of the upper bar 46 in the width direction toward the edge.

The slope of the upper surface 462 of the upper bar 46 may be steeper than the slope of the upper surface 472 of the lower bar 47. The height between the upper end and lower end of the upper surface 462 of the upper bar 46 may be greater than the height H1 of the upper portion 471 of the lower bar 47.

The lower surface 464 of the upper bar 46 may be horizontal.

The lower surface 464 of the upper bar 46 may be disposed higher than the lower bar 47. The lower surface 464 of the upper bar 46 may be located higher than the lower bar 47. The lower surface 464 of the upper bar 46 may be located higher than the upper surface 472 of the lower bar 47.

If the size of the hole 440 is large, the spoon may fall from the cutlery rack 40. In particular, since chopsticks C have a small cross section compared to spoons, forks, knives, etc., they are easy to drop from the cutlery rack 40.

The horizontal distance D1 may be smaller than the width W1 of the upper bar 46. The width W1 of the upper bar 46 may be smaller than the width W2 of the lower bar 47.

The horizontal distance D1 between the upper bar 46 and the lower bar 47 corresponds to the length of the orthogonal projection of the gap G1 between the upper bar 46 and the lower bar 47.

The small horizontal distance D1 between the upper bar 46 and the lower bar 47 may prevent spoons from dropping from the cutlery rack 40.

The upper portion 471 of the lower bar 47 has a small height H1, and the upper surface 472 of the lower bar 47 has a structure which is gently convex upward and advantageous for supporting the spoon C.

The spoon C supported on the lower bar 47 may contact the upper bar 46. The spoon C may have water remaining on a portion that contacts the upper bar 46.

The upper bar 47 may include a corner 463 where the upper surface 472 and the lower surface 474 meet. The corner 463 may be disposed closer to the lower bar 47 than other portion of the upper bar 47. The corner 463 may face the lower bar.

The spoon C supported on the lower bar 47 may contact the corner 463 of the upper bar.

Therefore, the water remaining on the spoon C may be minimized.

Referring to FIG. 11, the second bar 48 may include an upper surface 482 facing upward and a lower surface 484 facing downward.

The upper surface 482 of the second bar 48 may be inclined with respect to the horizontal. The lower surface 484 of the second bar 48 may be inclined with respect to the horizontal. The slope of the lower surface 484 of the second bar 48 may be steeper than the slope of the upper surface 482.

The upper surface of the second bar 48 may have a shape in which the central portion in the width W3 direction of the second bar 48 is convex upward. The lower surface of the second bar 48 may have a shape in which the central portion in the width W3 direction of the second bar 48 is convex downward.

The width W3 of the second bar 48 may be maximum at the height where the upper surface 482 and the lower surface 484 meet. The width W3 of the second bar 48 may be smaller than the gap G2 between the second bars 48. The width W3 of the second bar 48 may be greater than the horizontal distance D1 between the upper bar 46 and the lower bar 47.

The second bar 48 may include an upper portion providing an upper surface 482 and a lower portion providing a lower surface 484. The height of the lower portion of the second bar 48 may be larger than the height of the upper portion of the second bar 48.

FIG. 12 is a graph that scores performance by observing the water remaining on the spoon placed on a cutlery rack, after a drying cycle of a dishwasher is completed.

Prior in the graph represents the drying performance of a dishwasher equipped with a conventional cutlery rack having a structure shown in FIG. 17.

Experimental in the graph represents the drying performance of a dishwasher equipped with the cutlery rack 40 according to an embodiment of the present disclosure.

A dishwasher equipped with the cutlery rack 40 according to an embodiment of the present disclosure shows improved drying performance in comparison with a dishwasher equipped with a conventional cutlery rack.

Referring to FIG. 13, the third rack 33 may store cutlery. The third rack 33 may include a bottom muntin 345 and a frame 342 surrounding the bottom muntin 345.

The third rack 33 may be provided to be able to be pulled from the washing chamber 11. The third rack 33 may be provided to be able to be pulled independently from the first and second racks 31 and 32.

A handle 335 may be provided in the front of the frame 342. A roller 333 may be provided in both left and right sides of the frame 342.

The third rack 33 may have a bottom of the same structure as the bottom 44 of the cutlery rack 40.

The third rack 33 may include a bottom muntin 345 having the same structure as the bottom muntin 45 of the cutlery rack 40 described above.

The third rack 33 may be divided into a first area 331 and a second area 332.

At least one of the first and second areas 331 and 332 may be provided with a bottom muntin 345 having the same structure as the bottom muntin 45 of the cutlery rack 40 described above.

Referring to FIGS. 1 to 13, a dishwasher according to an embodiment of the present disclosure includes: a tub 10 which provides a washing chamber 11; a spray unit (50; 51; 52, 53) which is disposed in the washing chamber 11, and sprays washing water; and a cutlery rack 40 which is disposed in the washing chamber 11. The cutlery rack 40 includes a plurality of bars 45. The plurality of bars 45 includes: a plurality of first bars 46, 47 arranged parallel to each other; and a plurality of second bars which extend along a direction in which the plurality of first bars 46, 47 are arranged and connect the plurality of first bars 46, 47, and are arranged along a longitudinal direction of the first bar 46, 47. A gap between two adjacent first bars 46 among the plurality of first bars 46, 47 is smaller than a gap between two adjacent second bars 48 among the plurality of second bars 48.

The first bar 46, 47 includes: a plurality of upper bars 46; and a plurality of lower bars 47 which are disposed between the plurality of upper bars 46 in a direction in which the first bar 46, 47 is arranged, and disposed lower than the upper bar 46.

The upper bar 46 and the lower bar 47 may be arranged alternately.

A first horizontal distance D1 between the upper bar 46 and the lower bar 47 is smaller than a second horizontal distance D2 between the second bars.

The first horizontal distance D1 is smaller than a width W1, W2 of the first bar 46, 47.

The lower bar 47 includes: an upper portion 471 providing an upper surface facing upward, and a lower portion 473 extending downward from the upper portion 471, and in an up-down direction, a length H2 of the lower portion 473 is longer than a length H1 of the upper portion 471.

The lower portion 471 of the lower bar 47 has a width W2 that narrows downward.

The upper bar 46 faces upward, and includes an upper surface 462 inclined with respect to a horizontal.

The lower bar 47 faces upward, and includes an upper surface 472 inclined with respect to a horizontal, and a slope of the upper surface 462 of the upper bar 46 is steeper than a slope of the upper surface 472 of the lower bar 47.

The upper bar 46 includes a lower surface 464 facing downward, and the lower surface 464 of the upper bar 46 is disposed higher than the lower bar 47.

The upper bar 46 has a corner 463 where the upper surface 462 and the lower surface 464 meet, and the corner 463 is disposed closer to the lower bar 47 than other portion of the upper bar 46.

The lower surface 464 of the upper bar 46 is disposed to be horizontal.

The second bar 48 includes: an upper portion which provides an upper surface 482 facing upward, and becomes wider as it progresses downward; and a lower portion which provides a lower surface 484 facing downward, and has a width that narrows as it progresses downward, wherein a height of the lower portion is greater than a height of the upper portion.

The cutlery rack 40 further includes a lower rim 424 surrounding the bottom muntin 45, and at least one first bar 46, 47 among the plurality of first bars 46, 47 is spaced apart from the lower rim 424.

The first bar 46, 47 includes: an upper bar 46 connected to the lower rim 424; and a lower bar 47 which extends parallel to the upper bar 46, is disposed lower than the upper bar 46, and is spaced apart from the lower rim 424.

The cutlery rack 40 further includes a net 43 forming a side surface of the cutlery rack 40, wherein the net 43 includes: a horizontal bar 436 which extends horizontally, or extends in an inclined direction with respect to a horizontal; and a vertical bar 438 extending in an up-down direction, wherein the vertical bar 438 is connected to the second bar 48.

The cutlery rack 40 may be placed in the first rack 31.

A dishwasher according to an embodiment of the present disclosure includes: a tub 10 which provides a washing chamber 11; a spray unit (50; 51; 52; 53) which is disposed in the washing chamber 11, and sprays washing water; and a cutlery rack 40 which is disposed in the washing chamber 11, and includes a bottom muntin 45 providing a plurality of holes 440, wherein the bottom muntin 45 of the cutlery rack 40 includes: an upper bar 46; and a lower bar 47 which extends parallel to the upper bar 46, and is disposed lower than the upper bar 46.

The lower bar 47 includes: an upper portion 471 providing an upper surface facing upward; and a lower portion 473 which extends downward from the upper portion 471, and has a width that narrows downward.

The upper bar 46 includes a lower surface 474 facing downward, wherein the lower surface 464 of the upper bar 46 is disposed higher than the lower bar 47.

The upper bar 46 faces upward and includes an upper surface 462 inclined with respect to a horizontal, wherein the upper surface 462 of the upper bar 46 is steeper than the upper surface 472 of the lower bar 47.

A portion where the upper surface 462 and the lower surface 464 of the upper bar 46 meet forms a corner 463.

According to at least one of the embodiments of the present disclosure, it is possible to provide a cutlery rack for holding spoons and a dishwasher including the same.

According to at least one of the embodiments of the present disclosure, it is possible to provide a dishwasher including a cutlery rack in which chopsticks do not drop through a structure of hole provided by the bottom muntin.

According to at least one of the embodiments of the present disclosure, it is possible to provide a dishwasher that reduces the water remaining in the cutlery rack due to the structure of the bottom muntin and the hole. In addition, it is possible to provide a dishwasher that reduces the water remaining in the cutlery after a cycle is terminated. In addition, it is possible to provide a dishwasher that does not leave water marks after the cutlery is dried.

According to at least one of the embodiments of the present disclosure, it is possible to provide a dishwasher including a cutlery rack that has a structure in which water is guided downward and water is easily dropped through the disposition of the first and second bars forming the bottom muntin and the structure of the upper and lower portions of the first and second bars.

According to at least one of the embodiments of the present disclosure, it is possible to provide a dishwasher in which a water film is easily removed, even if a water film is formed in a hole at the bottom of a cutlery rack due to a height difference between the upper bar and the lower bar.

According to at least one of the embodiments of the present disclosure, it is possible to provide a dishwasher in which water condensed on the side surface of the cutlery rack can easily drop from the cutlery rack by connecting the side vertical bar and the bottom muntin.

According to at least one of the embodiments of the present disclosure, it is possible to provide a dishwasher that prevents a water film from being formed even in a relatively small hole disposed at the edge of the bottom of a cutlery rack by separating a portion of the bottom muntin from the frame.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a tub comprising a washing chamber;

a spray unit disposed in the washing chamber, the spray unit being configured to spray washing water; and a cutlery rack disposed in the washing chamber, the cutlery rack including a plurality of bars, wherein the plurality of bars comprise:

a plurality of first bars, wherein each of the plurality of first bars are parallel to other respective first bars; and a plurality of second bars extending along a longitudinal direction of the plurality of first bars, the plurality of second bars being connected to the plurality of first bars, wherein a gap between two adjacent first bars among the plurality of first bars is smaller than a gap between two adjacent second bars among the plurality of second bars, and wherein the plurality of first bars comprise:

a plurality of upper bars; and a plurality of lower bars, wherein one lower bar of the plurality of lower bars is disposed between adjacent upper bars of the plurality of upper bars, wherein the plurality of lower bars extend along the longitudinal direction of the plurality of first bars, and wherein the plurality of lower bars are disposed lower with respect to a vertical direction than the plurality of upper bars.

2. The dishwasher of claim 1, wherein a first horizontal distance between an upper bar of the plurality of upper bars and an adjacent lower bar of the plurality of lower bars is smaller than a second horizontal distance between adjacent second bars of the plurality of second bars.

3. The dishwasher of claim 2, wherein the first horizontal distance is smaller than a width of the first bar.

4. The dishwasher of claim 1, wherein the plurality of lower bars comprise:

an upper portion comprising an upper surface facing upward with respect to the vertical direction; and a lower portion extending downward from the upper portion, wherein a length of the lower portion is longer than a length of the upper portion with respect to the vertical direction.

5. The dishwasher of claim 4, wherein the lower portion of the lower bars have a width that decreases downward.

6. The dishwasher of claim 1, wherein the plurality of upper bars face upward with respect to the vertical direction, and comprise an upper surface inclined with respect to a horizontal direction.

7. The dishwasher of claim 6, wherein the plurality of lower bars face upward with respect to the vertical direction, and comprise an upper surface inclined with respect to the horizontal direction, and wherein a slope of the upper surface of the upper bars is steeper than a slope of the upper surface of the plurality of lower bars.

8. The dishwasher of claim 6, wherein the plurality of upper bars comprise a lower surface facing downward with respect to the vertical direction, and wherein the lower surface of the plurality of upper bars is disposed higher with respect to the vertical direction than the plurality of lower bars.

9. The dishwasher of claim 8, wherein the plurality of upper bars further comprise a corner, wherein the corner is an intersection of the upper surface and the lower surface, and wherein the corner is disposed closer to the plurality of lower bars than any other portion of the plurality of upper bars.

10. The dishwasher of claim 9, wherein the lower surface of the plurality of upper bars is a flat surface.

11. The dishwasher of claim 1, wherein the plurality of second bars comprise:

an upper portion comprising an upper surface facing upward with respect to the vertical direction, wherein the upper portion has a width that increases downward with respect to the vertical direction; and a lower portion comprising a lower surface facing downward with respect to the vertical direction, wherein the lower portion has a width that decreases downward with respect to the vertical direction, and wherein a height with respect to the vertical direction of the lower portion is greater than a height with respect to the vertical direction of the upper portion.

12. The dishwasher of claim 1, wherein the cutlery rack further comprises a lower rim, wherein the lower rim surrounds the plurality of bars, and wherein at least one first bar of the plurality of first bars is spaced apart from the lower rim.

13. The dishwasher of claim 12, wherein the plurality of first bars comprise:

an upper bar connected to the lower rim; and a lower bar parallel to the upper bar, wherein the lower bar is disposed lower with respect to the vertical direction than the upper bar, and wherein the lower bar is spaced apart from the lower rim.

14. The dishwasher of claim 12, wherein the cutlery rack further comprises a net forming a side surface of the cutlery rack, wherein the net comprises:

a horizontal bar; and a vertical bar, and wherein the vertical bar is connected to a second bar of the plurality of second bars.

15. A dishwasher comprising:

a tub comprising a washing chamber;

a spray unit disposed in the washing chamber, the spray unit being configured to spray washing water; and a cutlery rack disposed in the washing chamber, wherein the cutlery rack comprises a bottom muntin, wherein the bottom muntin comprises:

a plurality of holes;

an upper bar; and a lower bar parallel to the upper bar, and wherein the lower bar is disposed lower with respect to a vertical direction than the upper bar, wherein the lower bar comprises:

an upper portion comprising an upper surface facing upward with respect to the vertical direction; and a lower portion extending downward from the upper portion, and wherein the lower portion has a width that decreases downward.

16. The dishwasher of claim 15, wherein the upper bar comprises a lower surface facing downward with respect to the vertical direction, and wherein the lower surface of the upper bar is disposed higher with respect to the vertical direction than the lower bar.

17. The dishwasher of claim 16, wherein the upper bar faces upward with respect to the vertical direction and comprises an upper surface inclined with respect to a horizontal direction, and wherein the upper surface of the upper bar is steeper than the upper surface of the lower bar.

18. The dishwasher of claim 16, wherein the upper bar further comprises a corner, wherein the corner is an intersection of the upper surface and the lower surface, and wherein the corner is disposed closer to the lower bar than any other portion of the upper bar.

19. A dishwasher comprising:

a tub comprising a washing chamber;

a spray unit disposed in the washing chamber, the spray unit being configured to spray washing water; and a cutlery rack disposed in the washing chamber, the cutlery rack including a plurality of bars, wherein the plurality of bars comprise:

a plurality of first bars, wherein each of the plurality of first bars are parallel to other respective first bars; and a plurality of second bars extending along a longitudinal direction of the plurality of first bars, the plurality of second bars being connected to the plurality of first bars, wherein the plurality of first bars comprise:

a plurality of upper bars; and a plurality of lower bars, wherein one lower bar of the plurality of lower bars is disposed between adjacent upper bars of the plurality of upper bars, wherein the plurality of lower bars extend along the longitudinal direction of the plurality of first bars, and wherein the plurality of lower bars are disposed lower with respect to a vertical direction than the plurality of upper bars.

* * * * *